US008237753B2

(12) United States Patent
Murai et al.

(10) Patent No.: US 8,237,753 B2
(45) Date of Patent: Aug. 7, 2012

(54) DISPLAY DEVICE WITH GRADATION CONVERSION, AND METHOD THEREOF

(75) Inventors: Atsuhito Murai, Osaka (JP); Ryuji Miyama, Osaka (JP); Kozo Takahashi, Osaka (JP); Kenji Maeda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 125 days.

(21) Appl. No.: 12/734,928

(22) PCT Filed: Jul. 3, 2008

(86) PCT No.: PCT/JP2008/062053

§ 371 (c)(1),
(2), (4) Date: Jun. 3, 2010

(87) PCT Pub. No.: WO2009/081602

PCT Pub. Date: Jul. 2, 2009

(65) Prior Publication Data

US 2010/0245405 A1 Sep. 30, 2010

(30) Foreign Application Priority Data

Dec. 20, 2007 (JP) ..... 2007-328537

(51) Int. Cl.
*G09G 5/10* (2006.01)
*G09G 3/30* (2006.01)

(52) U.S. Cl. ..... 345/690; 345/77

(58) Field of Classification Search ..... 345/77, 345/690–697

See application file for complete search history.

(56) References Cited

U.S. PATENT DOCUMENTS 5,717,422 A 2/1998 Fergason
5,808,697 A 9/1998 Fujimura et al.
7,289,087 B2 * 10/2007 Date ..... 345/76
7,920,121 B2 * 4/2011 Shen et al. ..... 345/690
2001/0033260 A1 * 10/2001 Nishitani et al. ..... 345/87
2003/0222884 A1 12/2003 Ikeda et al.
2005/0017990 A1 1/2005 Yoshida
2005/0122287 A1 6/2005 Nishitani et al.

(Continued)

FOREIGN PATENT DOCUMENTS

JP 01-239859 9/1989

(Continued)

OTHER PUBLICATIONS

Supplementary European Search Report dated Jan. 26, 2011.

(Continued)

*Primary Examiner* — Bipin Shalwala
*Assistant Examiner* — Ryan A Lubit
(74) *Attorney, Agent, or Firm* — Harness, Dickey & Pierce P.L.C.

(57) ABSTRACT

A gradation conversion unit 23 performs, on an input image, gradation conversion in which a predetermined gain is applied to a gradation smaller than a boundary gradation CVth and a characteristic becomes a spline curve for a gradation larger than the boundary gradation. To determine a characteristic of the gradation conversion unit 23, an image analysis unit 22 obtains the boundary gradation CVth and a maximum gradation CVmax based on the input image, and determines a linear gain shift coefficient LGs so that the brightness decreasing rate of the maximum gradation CVmax when brightness control of a backlight 30 is performed becomes a limit value or less. In such a manner, power consumption of the backlight is reduced while suppressing deterioration in picture quality.

9 Claims, 7 Drawing Sheets

U.S. PATENT DOCUMENTS

| | | | | |
|---|---|---|---|---|
| 2006/0119612 | A1* | 6/2006 | Kerofsky et al. | 345/590 |
| 2006/0119613 | A1 | 6/2006 | Kerofsky | |
| 2006/0284823 | A1 | 12/2006 | Kerofsky et al. | |
| 2006/0284882 | A1 | 12/2006 | Kerofsky et al. | |
| 2007/0146236 | A1 | 6/2007 | Kerofsky et al. | |
| 2008/0136845 | A1* | 6/2008 | Nakanishi | 345/690 |

FOREIGN PATENT DOCUMENTS

| | | |
|---|---|---|
| JP | 05-083596 | 4/1993 |
| JP | 09-065252 | 3/1997 |
| JP | 2001-343957 | 12/2001 |
| JP | 2004-054250 | 2/2004 |
| JP | 2004-325628 | 11/2004 |
| JP | 2004-354882 | 12/2004 |
| JP | 2005-107019 | 4/2005 |
| JP | 2005-130486 | 5/2005 |
| JP | 2008-160607 | 7/2008 |
| JP | 2009-205128 | 9/2009 |
| JP | 2006-293328 | 10/2010 |
| JP | 2006-293365 | 10/2010 |
| WO | WO 2005/093703 | 10/2005 |

OTHER PUBLICATIONS

International Search Report.

* cited by examiner

| CVmax-CVth | LGs |
|---|---|
| 0 ≦ D < 16 | 0.0 |
| 16 ≦ D < 32 | 0.0 |
| 32 ≦ D < 48 | 0.2 |
| 48 ≦ D < 64 | 0.5 |
| 64 ≦ D < 80 | 0.6 |
| 80 ≦ D < 96 | 0.7 |
| 96 ≦ D < 112 | 0.8 |
| 112 ≦ D < 128 | 0.8 |
| 128 ≦ D < 144 | 0.8 |
| 144 ≦ D < 168 | 0.8 |
| 160 ≦ D < 178 | 0.8 |
| 176 ≦ D < 192 | 0.8 |
| 192 ≦ D < 208 | 0.8 |
| 208 ≦ D < 224 | 0.8 |
| 224 ≦ D < 240 | 0.8 |
| 240 ≦ D < 256 | 0.8 |

DISPLAY DEVICE WITH GRADATION CONVERSION, AND METHOD THEREOF

TECHNICAL FIELD

The present invention relates to a display device and, more particularly, to a display device performing brightness control of a backlight and gradation conversion of an image.

BACKGROUND ART

In a display device having a backlight such as a liquid crystal display device, by performing brightness control of the backlight in accordance with an input image, power consumption of the backlight can be reduced. By performing, on the input image, gradation conversion which compensates a drop amount of the brightness of the backlight together with the brightness control of the backlight, while displaying an image similar to that of the case where the brightness control is not performed, power consumption of the backlight can be reduced.

There are the following methods of performing the brightness control of a backlight and the gradation conversion of an image. In a first method, a histogram of an input image is generated, a gradation in a position of a predetermined ratio (for example, a position of 90%) from a smaller side of the gradations of pixels included in the input image is obtained, and all of gradations larger than the obtained gradation are converted to a maximum gradation. In a second method, a data distribution or the like is analyzed based on a histogram of an input image and, according to an analysis result, a γ value of a γ curve is switched (for example, the γ value is switched from 2.2 to 1.8).

Patent document 1 describes an image display device having: means that detects the maximum value of image signals in one screen; light-transmission-type display means whose light transmittance becomes constant at the detected maximum value; and a light source obtaining a light output proportional to the detected maximum value. Patent document 2 describes an image adjusting method of applying a predetermined gain to a gradation smaller than a maximum faithful reproduction gradation and applying, to a gradation larger than the maximum faithful reproduction gradation, a roll-off curve using the maximum value of the gradation as a final reach point. Patent document 3 describes an image display method of obtaining a characteristic determination amount from display data and performing brightness conversion by applying a gain which changes before and after the characteristic determination amount. Patent document 4 describes a display device which controls intensity of light from a light source incoming to a light modulation display unit in accordance with an image to be displayed.

[Patent document 1] Japanese Laid-Open Patent Publication No. Hei 01-239589

[Patent document 2] Japanese Laid-Open Patent Publication No. 2006-293328

[Patent document 3] Japanese Laid-Open Patent Publication No. 2004-54250

[Patent document 4] U.S. Pat. No. 5,717,422

DISCLOSURE OF THE INVENTION

Problems to be Solved by the Invention

The conventional methods, however, have the following problems. FIG. 8 is a diagram showing the gradation conversion characteristic and the display brightness characteristic of the first method. In FIG. 8, CVM denotes the maximum value of the gradation, and CVth denotes a gradation in a position of 90% from a smaller side in gradations of pixels included in an input image. In the method, all of gradations larger than CVth are converted to CVM, so that brightnesses when displaying the gradations larger than CVth are the same (X1 portion in FIG. 8). Consequently, in the first method, "gradation collapse" that the gradations in a certain range are expressed with the same brightness occurs.

FIG. 9 is a diagram showing the gradation conversion characteristic and the display brightness characteristic of the second method. In the method, gradation collapse does not occur. However, since the γ value is switched, brightness when displaying a small gradation is inaccurate (X2 portion in FIG. 9). Consequently, in the second method, "gradation deviation" that a deviated gradation is displayed occurs.

In the method described in the patent document 1, if even one maximum value of the gradations is included in an input image, the brightness of the backlight cannot be lowered. Consequently, the case where the power consumption of the backlight can be reduced is limited.

In the method described in the patent document 2, no limit is provided for the brightness decreasing rate in picture quality adjustment. Consequently, for example, when a white character in a black background is displayed, the brightness of the character largely drops. Since the final reach point of the roll-off curve is the maximum value of gradation, even in the case where the maximum gradation included in the input image is different from the maximum value of gradation (for example, when the maximum value of gradation is 255 and the maximum gradation included in an input image is 128), power consumption cannot be reduced. Further, since priority is given on reduction in power consumption of a backlight, there is a case that the quality of a display image largely deteriorates.

Patent document 3 describes the details of a method of linearly changing a gain before and after the characteristic determination amount, but the document does not describe the details of a method of changing the gain curvedly. When the gain is linearly changed before and after the characteristic determination amount in accordance with description of the document, continuity of the gradation deteriorates before and after the characteristic determination amount. Also by the method of the patent document 3, the problem that the brightness of a white character in a black background decreases cannot be solved.

Therefore, an object of the present invention is to provide a display device realizing reduction in power consumption of a backlight while suppressing deterioration in picture quality.

Means for Solving the Problems

A first aspect of the present invention relates to a display device performing brightness control of a backlight and gradation conversion of an image, including: a display panel including a plurality of pixel circuits; a drive circuit that drives the display panel; a backlight that irradiates a back side of the display panel with light; a gradation conversion unit that performs gradation conversion on an input image, by applying a predetermined gain to a gradation smaller than a boundary gradation and applying, to a gradation larger than the boundary gradation, a gain which decreases as the gradation increases, and that outputs a converted image to the drive circuit; and an image analysis unit that analyzes the input image and determines a characteristic of the gradation conversion unit and brightness of the backlight, wherein the image analysis unit obtains the boundary gradation and the maximum gradation included in the input image based on the input image and, based on the obtained two gradations, determines a characteristic of the gradation conversion unit so that brightness decreasing rate of the maximum gradation when the brightness control of the backlight is performed becomes a limit value or less.

A second aspect of the present invention is characterized in that, in the first aspect of the invention, the image analysis unit determines a parameter that determines a characteristic of the gradation conversion unit so that the brightness decreasing rate becomes the limit value or less, based on the difference between the maximum gradation and the boundary gradation.

A third aspect of the present invention is characterized in that, in the second aspect of the invention, the parameter is a ratio to the difference between the maximum gradation and the boundary gradation.

A fourth aspect of the present invention is characterized in that, in the third aspect of the invention, when the boundary gradation is CVth, the maximum gradation is CVmax, the parameter is LGs, the maximum value of an output gradation of the gradation conversion unit is CVM, {CVth+LGs (Cvmax−CVth)} is set as CVa, and (CVM/CVa)×CVth is set as CVb, the gradation conversion unit performs gradation conversion with a gain of (CVM/CVa) to a gradation smaller than the boundary gradation, and performs gradation conversion to a gradation larger than the boundary gradation so that a characteristic becomes a spline curve using a point (CVth, CVb) as a starting point, a point (CVa, CVM) as a control point, and a point (CVmax, CVM) as an end point.

A fifth aspect of the present invention is characterized in that, in the second aspect of the invention, in the image analysis unit, the parameter which determines so that the brightness decreasing rate becomes the limit value or less in association with the difference between the maximum gradation and the boundary gradation is preliminarily stored.

A sixth aspect of the present invention is characterized in that, in the first aspect of the invention, on a gradation larger than the boundary gradation, the gradation conversion unit performs gradation conversion so that a characteristic becomes a spline curve.

A seventh aspect of the present invention is characterized in that, in the first aspect of the invention, the image analysis unit determines brightness of the backlight so that, for a gradation smaller than the boundary gradation, display brightness when the brightness control of the backlight and the gradation conversion by the gradation conversion unit are performed coincides with display brightness when the brightness control and the gradation conversion are not performed.

An eighth aspect of the present invention is characterized in that, in the first aspect of the invention, the image analysis unit determines, as the boundary gradation, a gradation in a position at a predetermined ratio from a smaller or larger side of the gradations of pixels included in the input image.

A ninth aspect of the present invention relates to a display method using a display device having a display panel, a drive circuit of the display panel, and a backlight, the method including the steps of: performing gradation conversion on an input image by applying a predetermined gain to a gradation smaller than a boundary gradation and applying, to a gradation larger than the boundary gradation, a gain which decreases as the gradation increases; driving the display panel based on a converted image by using the drive circuit; irradiating a back side of the display panel with light by using the backlight; and analyzing the input image and determining a gradation conversion characteristic and brightness of the backlight, wherein in the step of determining the gradation conversion characteristic, the boundary gradation and the maximum gradation included in the input image are obtained based on the input image and, based on the obtained two gradations, the gradation conversion characteristic is determined so that brightness decreasing rate of the maximum gradation when the brightness control of the backlight is performed becomes a limit value or less.

Effect of the Invention

According to the first or ninth aspect of the invention, by analyzing an input image and performing the brightness control of the backlight based on the analysis result, power consumption of the backlight can be reduced according to the characteristic of the input image. By limiting the brightness decreasing rate of the maximum gradation when the brightness control of the backlight is performed, an image can be displayed without largely deteriorating brightness of the maximum gradation or gradations close to the maximum gradation. By applying a predetermined gain to gradations smaller than the boundary gradation and applying a gain which monotonously decreases to gradations larger than the boundary gradation, the gradation collapse and gradation deviation can be suppressed. Thus, while suppressing deterioration in picture quality, power consumption of the backlight can be reduced.

According to the second aspect of the invention, by deciding the parameter which determines the characteristic of the gradation conversion unit so that the brightness decreasing rate of the maximum gradation becomes the limit value or less, based on the difference between the maximum gradation and the boundary gradation, while suppressing deterioration in picture quality, power consumption of the backlight can be reduced.

According to the third aspect of the invention, by determining the ratio to the difference between the maximum gradation and the boundary gradation based on the difference between the maximum gradation and the boundary gradation so that the brightness decreasing rate of the maximum gradation becomes the limit value or less and determining the characteristic of the gradation conversion unit by using the determined rate, while suppressing deterioration in picture quality, power consumption of the backlight can be reduced.

According to the fourth aspect of the present invention, by performing the gradation conversion on a gradation larger than the boundary gradation so that a characteristic becomes a spline curve, the gradation conversion characteristic in a portion larger than the boundary gradation changes continuously and smoothly. The spline curve is tangent, at the boundary gradation, with the gradation conversion characteristic of a portion smaller than the boundary gradation, so that the gradation conversion characteristic changes continuously and smoothly before and after the boundary gradation. Therefore, the output gradation of the gradation conversion unit and the display brightness can be prevented from becoming discontinuous, and deterioration in picture quality can be suppressed.

According to the fifth aspect of the invention, by preliminarily storing the parameter determined so that the brightness decreasing rate becomes the limit value or less, the parameter in which the brightness decreasing rate of the maximum gradation becomes the limit value or less can be easily obtained.

According to the sixth aspect of the present invention, by performing the gradation conversion so that a characteristic becomes a spline curve on a gradation larger than the boundary gradation, the gradation conversion characteristic of a portion larger than the boundary gradation changes continuously and smoothly. Therefore, on gradations larger than the boundary gradation, the output gradation of the gradation conversion unit and the display brightness can be prevented from becoming discontinuous, and deterioration in picture quality can be suppressed.

According to the seventh aspect of the present invention, by preferably controlling brightness of the backlight, for a gradation smaller than the boundary gradation, an image is displayed with the same brightness as that when the brightness control and the gradation conversion are not performed, and an image similar to that when the brightness control and the gradation conversion are not performed can be displayed. By determining brightness of the backlight not based on the maximum value of gradation, but based on the maximum gradation included in the input image, power consumption of the backlight can be reduced more effectively.

According to the eighth aspect of the present invention, by determining the boundary gradation based on the ratio, pixels in predetermined proportion included in an input image can be subjected to gradation conversion of applying a predetermined gain and displayed. By suitably controlling the brightness of the backlight, pixels in the predetermined proportion included in an input image can be displayed with the same brightness as that in the case where the brightness control and the gradation conversion are not performed.

DESCRIPTION OF THE REFERENCE NUMERALS

Figure 1:
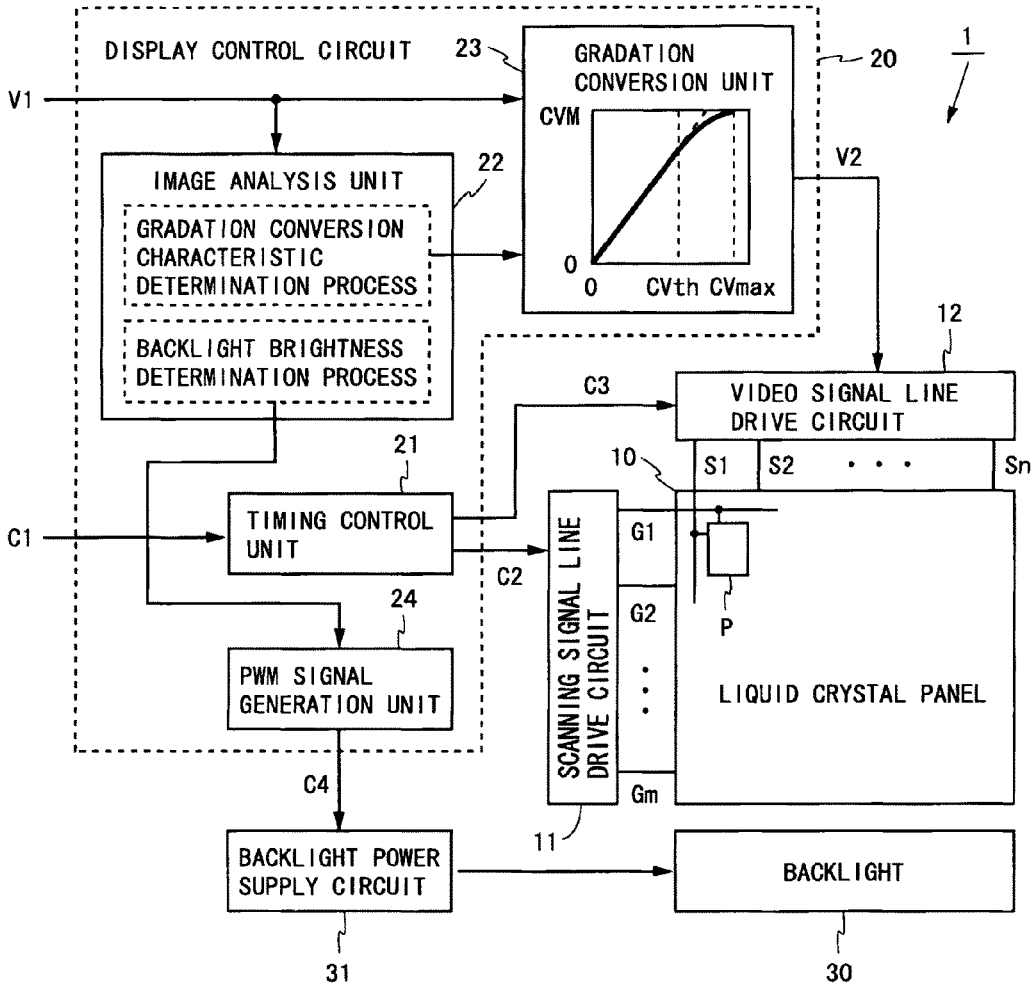
FIG. 1 is a block diagram showing the configuration of a liquid crystal display device according to an embodiment of the invention.

1 liquid crystal display device
10 liquid crystal panel
11 scanning signal line drive circuit
12 video signal line drive circuit
20 display control circuit
21 timing control unit
22 image analysis unit
23 gradation conversion unit
24 PWM signal generation unit
30 backlight
31 backlight power supply circuit

BEST MODE FOR CARRYING OUT THE INVENTION

FIG. 1 is a block diagram showing the configuration of a liquid crystal display device according to an embodiment of the invention. A liquid crystal display device 1 shown in FIG. 1 has a liquid crystal panel 10, a scanning signal line drive circuit 11, a video signal line drive circuit 12, a display control circuit 20, a backlight 30, and a backlight power supply circuit 31. The display control circuit 20 includes a timing control unit 21, an image analysis unit 22, a gradation conversion unit 23, and a PWM (Pulse Width Modulation) signal generation unit 24.

To the liquid crystal display device 1, a video signal V1 indicative of an image (hereinbelow, called an input image) to be displayed on the liquid crystal panel 10 and a timing control signal C1 indicative of an input timing of the video signal V1 are input. The liquid crystal display device 1 analyzes the input image, displays an image subjected to gradation conversion according to an analysis result on the liquid crystal panel 10, and controls the brightness of the backlight 30 in accordance with the analysis result. In the following, it is assumed that the input image includes three color components (R component, G component, and B component).

The liquid crystal panel 10 includes m pieces of scanning signal lines G1 to Gm, n pieces of video signal lines S1 to Sn, and (m×n) pieces of pixel circuits P (where each of m and n is an integer of two or larger). The scanning signal lines G1 to Gm are disposed in parallel with one another, and the video signal lines S1 to Sn are disposed in parallel with one another so as to be orthogonal to the scanning signal lines G1 to Gm. The (m×n) pieces of pixel circuits P are disposed two-dimensionally at cross points of the scanning signal lines G1 to Gm and the video signal lines S1 to Sn. Each of the scanning signal lines G1 to Gm is connected to the pixel circuits P disposed in the same row. Each of the video signal lines 51 to Sn is connected to the pixel circuits P disposed in the same column.

The timing control signal C1 input to the liquid crystal display device 1 includes a horizontal synchronizing signal HSYNC and a vertical synchronizing signal VSYNC. Based on the timing control signal C1, the timing control unit 21 outputs a timing control signal C2 to the scanning signal line drive circuit 11 and a timing control signal C3 to the video signal line drive circuit 12. The image analysis unit 22 analyzes the input image and determines the characteristic of the gradation conversion unit 23 and the brightness of the backlight 30 based on an analysis result (the details will be described later). The gradation conversion unit 23 performs, on the video signal V1, gradation conversion having the characteristic determined by the image analysis unit 22, and outputs a video signal V2 subjected to the conversion to the video signal line drive circuit 12. The PWM signal generation unit 24 outputs a PWM signal C4 having a width according to the brightness determined by the image analysis unit 22.

The scanning signal line drive circuit 11 and the video signal line drive circuit 12 are drive circuits of the liquid crystal panel 10. The scanning signal line drive circuit 11 sequentially selects the scanning signal lines G1 to Gm in accordance with the timing control signal C2. The video signal line drive circuit 12 applies voltages according to the video signal V2 to the video signal lines S1 to Sn in accordance with the timing control signal C3. Thus, the voltage according to the video signal V2 can be written via the video signal line to the pixel circuit P connected to the selected scanning signal line. The transmittance of the pixel in the liquid crystal panel 10 is determined by the voltage written in the pixel circuit P. Therefore, by using the scanning signal line drive circuit 11 and the video signal line drive circuit 12, an image based on the video signal V2 can be displayed on the liquid crystal panel 10.

The backlight 30 includes a plurality of light sources (not shown) and irradiates a back side of the liquid crystal panel 10 with light (backlight). The backlight power supply circuit 31 supplies the source voltage to the backlight 30 only for a period in which the PWM signal C4 is at a predetermined level (for example, high level). Therefore, the brightness of the backlight 30 can be made coincide with the brightness determined by the image analysis unit 22 by using the PWM signal generation unit 24 and the backlight power supply circuit 31.

Figure 2:
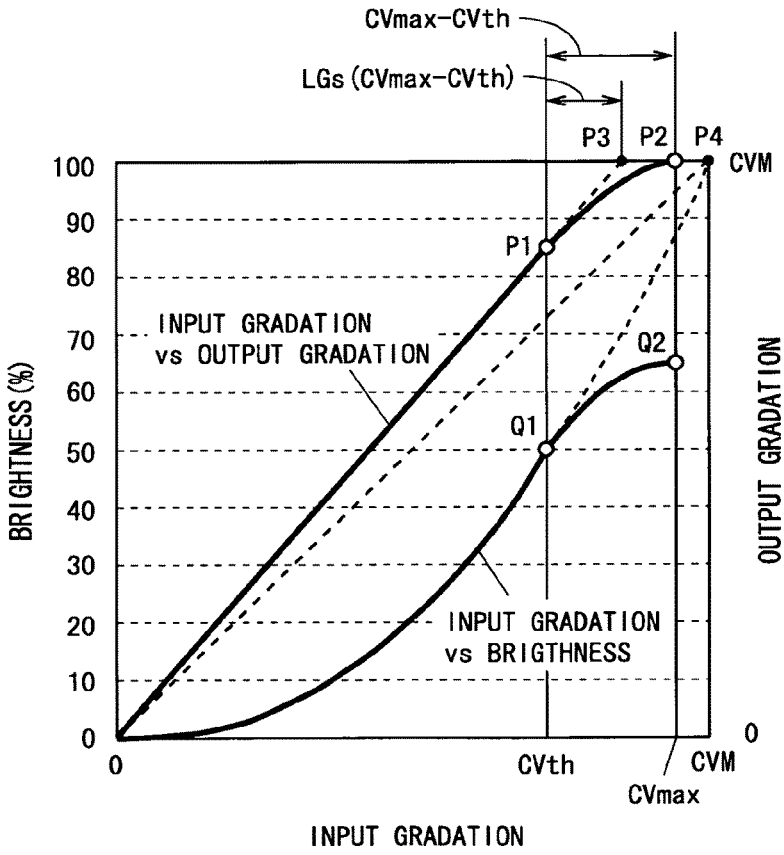
FIG. 2 is a diagram showing a gradation conversion characteristic and a display brightness characteristic of the liquid crystal display device illustrated in FIG. 1.

FIG. 2 is a diagram showing the gradation conversion characteristic and the display brightness characteristic of the liquid crystal display device 1. In FIG. 2, the origin is O, the horizontal axis is called an x axis, and the vertical axis is called a y axis. The minimum value of gradation which is input/output to/from the gradation conversion unit 23 is 0, and the maximum value is CVM. For example, in the case of a video signal of eight bits, the maximum value CVM of gradation is 255. The gradation conversion characteristic expresses the relation between input gradation and output gradation of the gradation conversion unit 23 and is given by a line segment OP1 and a curve P1P2 in FIG. 2. The display brightness characteristic expresses the relation between the input gradation of the gradation conversion unit 23 and the brightness (relative brightness when maximum brightness is 100%) of the liquid crystal panel 10 and is given by a curve OQ1 and a curve Q1Q2 in FIG. 2.

Three values (the maximum gradation CVmax, border gradation CVth, and linear gain shift coefficient LGs) other than CVM shown in FIG. 2 are obtained by the image analysis unit 22. The maximum gradation CVmax is generally different from the maximum value CVM of gradation, and $0 \leqq CVth \leqq Cvmax \leqq CVM$ is satisfied. The linear gain shift coefficient LGs takes a value between 0 and 1 inclusive. FIG. 2 shows, for reference, the gradation conversion characteristic (line segment OP4) and the display brightness characteristic (curve OQ1 and curve Q1P4: γ curve in which the γ value is 2.2) when the gradation conversion unit 23 performs gradation conversion with the gain of 1.

The gradation conversion characteristic shown in FIG. 2 is determined by the maximum gradation CVmax, the boundary gradation CVth, and the linear gain shift coefficient LGs. The gradation conversion characteristic is determined by the following method based on the three values. First, using the following equation (1), gradation CVa which is larger than the boundary gradation CVth only by LGs times of the difference between the maximum gradation and the boundary gradation is obtained.

$$CVa = CVth + LGs(Cvmax - CVth) \quad (1)$$

Next, the intersection of the line segment connecting the origin O and the point P3 (CVa, CVM) and a straight line x=CVth is set as P1. The line segment OP1 is expressed by the following equation (2), and a y coordinate CVb of the point P1 is given by the following equation (3).

$$y = (CVM/CVa) \times x \text{(where } 0 \leqq x \leqq CVth) \quad (2)$$

$$CVb = (CVM/CVa) \times CVth \quad (3)$$

The curve P1P2 is a spline curve of second order using the point P1 (CVth, CVb) as a starting point, the point P3 (CVa, CVM) as a control point, and the point P2 (CVmax, CVM) as an end point. The point (x, y) on the curve P1P2 is expressed by the following equations (4) and (5) using a parameter t ($0 \leqq t \leqq 1$).

$$x = (1-t)^2 \times P1x + 2(1-t)t \times P3x + t^2 \times P2x \quad (4)$$

$$y = (1-t)^2 \times P1y + 2(1-t)t \times P3y + t^2 \times P2y \quad (5)$$

In the equations (4) and (5), Pix (i=1 to 3) expresses the x coordinate of the point Pi, and Piy expresses the y coordinate of the point Pi.

The larger the input gradation is, the more the curve P1P2 is apart from the line segment P1P3 and an extension of P1P3. Consequently, for gradations larger than the boundary gradation CVth, a gain which decreases as the gradation increases is applied. Since the curve P1P2 is tangent with the line segment P1P3 at the point P1, the output gradation changes continuously and smoothly before and after the boundary gradation CVth. Since the curve P1P2 is tangent with the line segment P2P3 at the point P2, the change amount of the output gradation becomes almost zero near the maximum gradation CVmax.

As described above, the gradation conversion unit 23 performs, on an input image, the gradation conversion of applying a predetermined gain (CVM/CVa) to gradations smaller than the boundary gradation CVth and performs the gradation conversion of applying the gain which decreases as the gradation increases to gradations larger than the boundary gradation CVth (gradation conversion that the characteristic becomes the spline curve P1P2).

Figure 3:
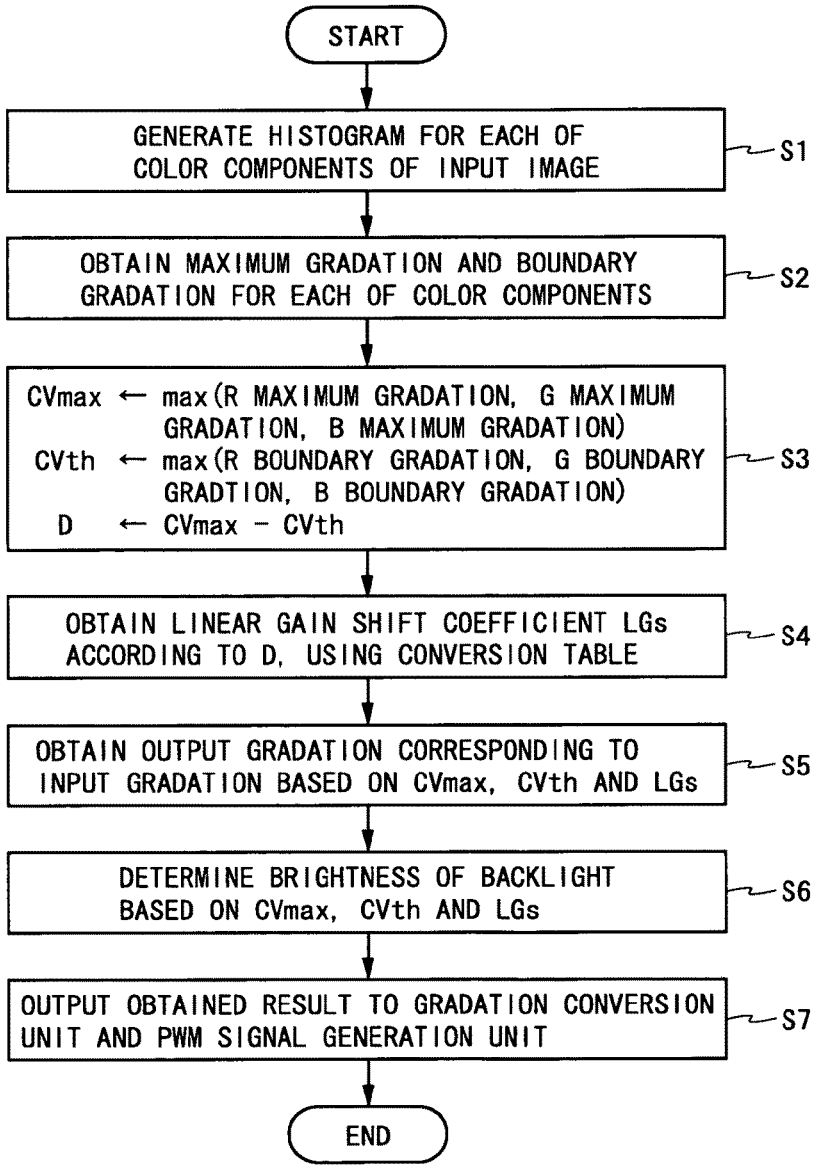
FIG. 3 is a flowchart showing processes of an image analysis unit in the liquid crystal display device illustrated in FIG. 1.
Figures 4, 5:
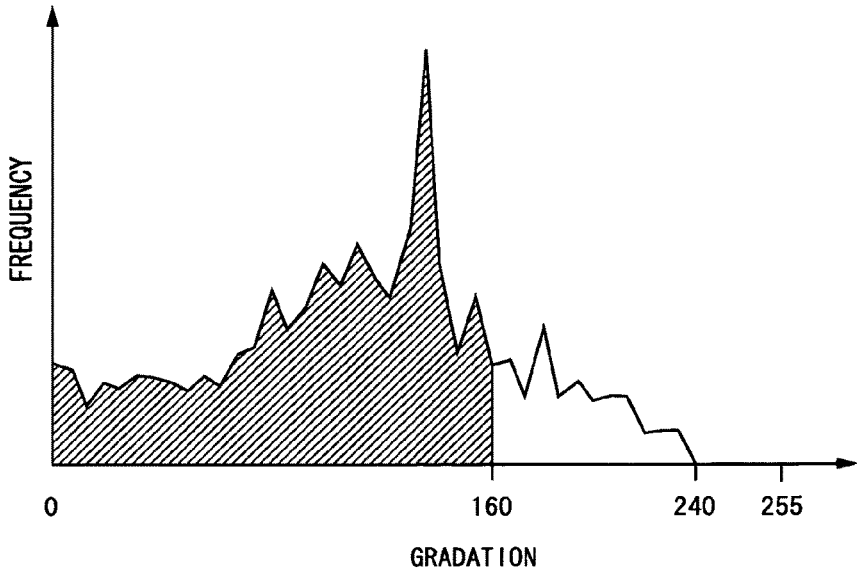
FIG. 4 is a diagram showing an example of a histogram generated by the liquid crystal display device illustrated in FIG. 1.
FIG. 5 is a diagram showing an example of a conversion table of the liquid crystal display device illustrated in FIG. 1.

FIG. 3 is a flowchart showing processes of the image analysis unit 22. The image analysis unit 22 performs processes shown in FIG. 3 on each input image. As shown in FIG. 3, first, the image analysis unit 22 generates a histogram for each of color components of the input image (step S1). FIG. 4 is a diagram showing an example of the histogram generated in step S1. For example, when an input image includes three color components, three histograms as shown in FIG. 4 are generated.

Next, the image analysis unit 22 obtains the maximum gradation and the boundary gradation for each of the color components by using the generated histograms (step S2). The maximum gradation denotes the maximum gradation included in one color component. The boundary gradation denotes a gradation in a position of (100×R) % from a smaller side of gradations of pixels included in one color component. The ratio R ($0 \leqq R \leqq 1$) is preliminarily determined based on a picture quality evaluation result of a display image or the like. For example, when a hatched portion in FIG. 4 is 80% of the whole and the ratio R is 0.8, the boundary gradation is 160. In FIG. 4, the maximum gradation is 240.

The image analysis unit 22 obtains the maximum value (hereinbelow, called maximum gradation CVmax) of the maximum gradation of the R component, the maximum gradation of the G component, and the maximum gradation of the B component and the maximum value (hereinbelow, called the boundary gradation CVth) of the boundary gradation of the R component, the boundary gradation of the G component, and the boundary gradation of the B component, and obtains the difference D of them (=CVmax−CVth) (step S3).

The image analysis unit 22 obtains the linear gain shift coefficient LGs according to the difference D (step S4). To obtain the linear gain shift coefficient LGs, the image analysis unit 22 has therein a conversion table storing the linear gain shift coefficient LGs in association with the difference D. FIG. 5 is a diagram showing an example of the conversion table. Using the conversion table as shown in FIG. 5, the image analysis unit 22 obtains the linear gain shift coefficient LGs according to the difference D. The linear gain shift coefficient LGs stored in the conversion table is determined so that the brightness decreasing rate of the maximum gradation CVmax when the brightness control of the backlight 30 is performed becomes a limit value or less (the details will be described later).

Based on the maximum gradation CVmax, the boundary gradation CVth, and the linear gain shift coefficient LGs, the image analysis unit 22 obtains an output gradation corresponding to the input gradation by the above-described method (step S5).

Based on the maximum gradation CVmax, the boundary gradation CVth, and the linear gain shift coefficient LGs, the image analysis unit 22 determines brightness of the backlight 30 (step S6). In step S6, the brightness of the backlight 30 is determined so that, for a gradation smaller than the boundary gradation CVth, display brightness when the brightness control of the backlight 30 and the gradation conversion by the gradation conversion unit 23 are performed coincides with the display brightness when the brightness control and the gradation conversion are not performed. For example, when the display brightness characteristic is a γ curve in which the γ value=k, the brightness of the backlight 30 is determined as $(CVa/CVM)^k$ times of the maximum brightness.

The image analysis unit 22 outputs the gradation conversion characteristic determined in step S5 to the gradation conversion unit 23 and outputs the brightness determined in step S6 to the PWM signal generation unit 24 (step S7). The gradation conversion unit 23 includes a table (not shown) for storing output gradations corresponding to input gradations in order to store the gradation conversion characteristic. The gradation conversion characteristic determined in step S5 is stored in the table. The brightness determined in step S6 is converted to a PWM signal C4 by the PWM signal generation unit 24.

As described above, the image analysis unit 22 obtains the boundary gradation CVth and the maximum gradation CVmax based on an input image and, based on the two gradations obtained, determines the characteristic of the gradation conversion unit 23 so that the brightness decreasing rate of the maximum gradation CVmax when the brightness control of the backlight 30 is performed becomes the limit value or less. In addition, the image analysis unit 22 determines brightness of the backlight 30 so that, for a gradation smaller than the boundary gradation CVth, display brightness when the brightness control of the backlight 30 and the gradation conversion by the gradation conversion unit 23 are performed coincides with the display brightness when the brightness control and the gradation conversion are not performed.

Figure 6:
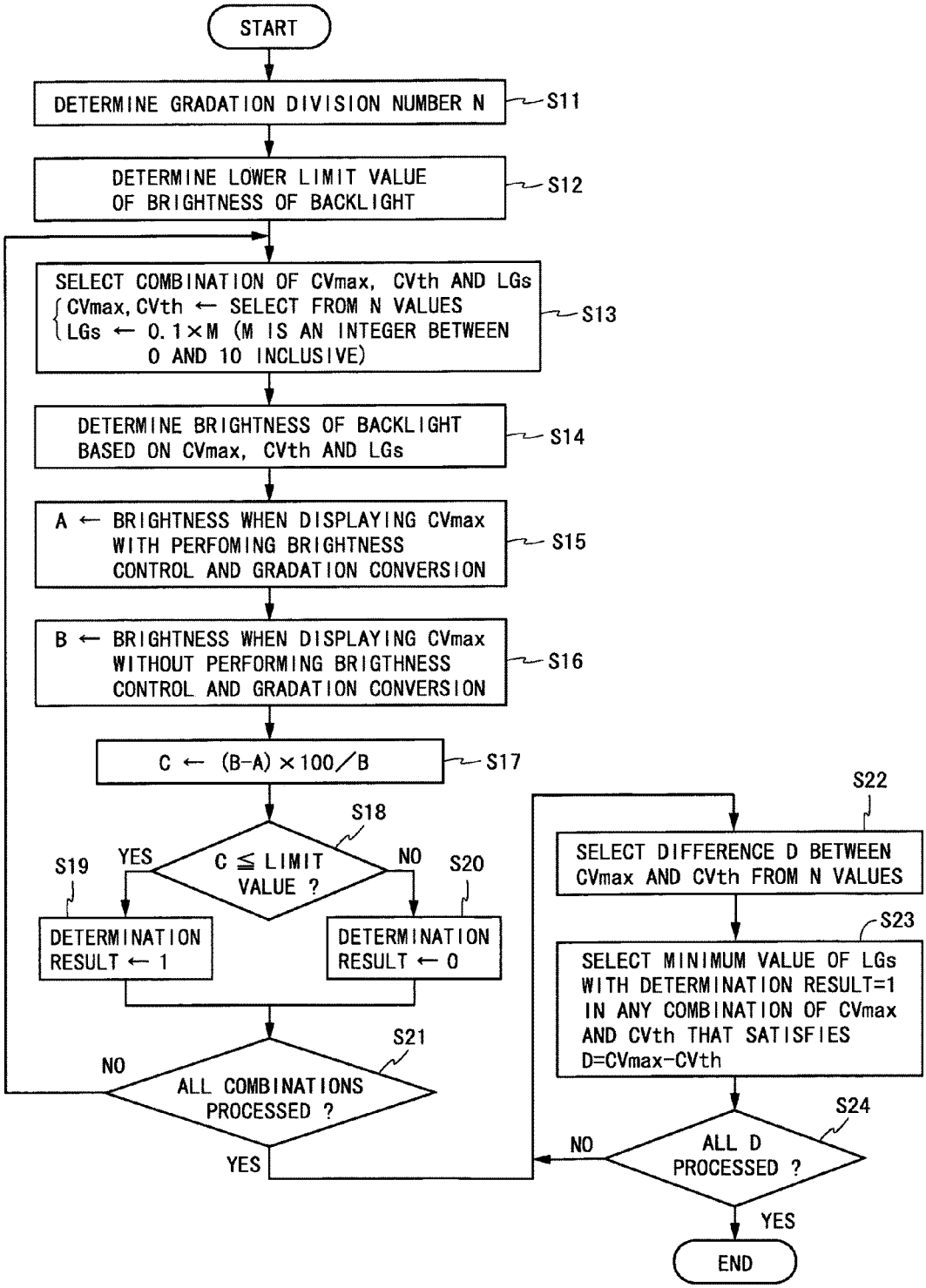
FIG. 6 is a flowchart of processes for obtaining a linear gain shift coefficient of the liquid crystal display device illustrated in FIG. 1.

In the following, a method of obtaining the linear gain shift coefficient LGs according to the difference D between the maximum gradation CVmax and the boundary gradation CVth will be described. FIG. 6 is a flowchart of processes for obtaining a linear gain shift coefficient LGs. The processes shown in FIG. 6 are performed at the time of designing the liquid crystal display device 1. The linear gain shift coefficient LGs obtained by the process is stored in the conversion table (FIG. 5) in the image analysis unit 22.

In the processes shown in FIG. 6, first, the gradation division number N is determined (step S11). In the example shown in FIG. 5, the gradation division number N is determined as 16. In this case, 256 gradations are divided into 16 classes, and total 16 gradations (for example, the minimum gradation, the maximum gradation, or the gradation in the center in the class) corresponding to the classes are determined. Next, the lower limit value of the brightness of the backlight is determined (step S12). The lower limit value of the brightness of the backlight is determined as, for example, 10% of the maximum brightness.

Subsequently, in steps S13 to S21, with respect to a combination of the values of the maximum gradation CVmax, the boundary gradation CVth, and the linear gain shift coefficient LGs, whether the brightness decreasing rate of the maximum gradation CVmax is equal to or less than a limit value is determined. More specifically, first, the maximum gradation CVmax and the boundary gradation CVth are selected so as to satisfy CVth≦CVmax from N gradations corresponding to the classes, one integer is selected from between 0 and 10 inclusive, and a value obtained by multiplying the integer by 0.1 is set as the linear gain shift coefficient LGs (step S13). Next, in a manner similar to step S6 shown in FIG. 3, the brightness of the backlight is determined based on the maximum gradation CVmax, the boundary gradation CVth, and the linear gain shift coefficient LGs (step S14).

Next, brightness A when displaying the maximum gradation CVmax with performing the brightness control and the gradation conversion is obtained (step S15), and brightness B when displaying the maximum gradation CVmax without performing the brightness control and the gradation conversion is obtained (step S16). At the time of obtaining the brightness A in step S15, the brightness of the backlight is the lower limit value determined in step S12 or more. Subsequently, based on the two brightnesses A and B obtained, brightness decreasing rate C when displaying the maximum gradation CVmax is obtained by the following equation (6) (step S17).

$$C=(B-A)\times 100/B \tag{6}$$

Next, whether the brightness decreasing rate C is within a predetermined limit value or not is determined (step S18). When the brightness decreasing rate C is the limit value or less, the determination result is set as 1 (step S19). When the brightness decreasing rate C exceeds the limit value, the determination result is set as 0 (step S20). The limit value used in step S18 is determined as, for example, 40% based on the picture quality evaluation result of the display image or the like. Whether all of combinations of the maximum gradation CVmax, the boundary gradation CVth, and the linear gain shift coefficient LGs have been processed or not is determined (step S21). When there is a combination which is not processed, the routine advances to step S13. When all of the combinations are processed, the routine advances to step S22.

In the latter case, the difference D between the maximum gradation CVmax and the boundary gradation CVth is selected from the N gradations corresponding to the classes (step S22). Next, the minimum value of LGs with the determination result is 1 in any combination of the values when the maximum gradation CVmax and the boundary gradation CVth are selected so as to satisfy D=Cvmax−CVth from the N gradations corresponding to the classes is selected as the linear gain shift coefficient LGs corresponding to the difference D (step S23). Whether all of the differences D have been processed or not is determined (step S24). When there is an unprocessed difference, the routine advances to step S22. When all of the differences are processed, the process is finished.

By performing the processes (the processes shown in FIG. 6), the conversion table (FIG. 5) of the image analysis unit 22 can be obtained. When the linear gain shift coefficient LGs in the case where the difference D is small is obtained by the processes shown in FIG. 6, there is a case that LGs becomes zero. However, if the value is used as it is, gradation collapse occurs. In the case of placing priority on suppression of the gradation collapse, the obtained value may be corrected to, for example, 0.1, 0.2, or the like. On the contrary, in the case of placing priority on reduction of power consumption, the obtained value 0 may be used as it is.

By the processes shown in FIG. 6, the linear gain shift coefficient LGs can be determined so that the brightness decreasing rate of the maximum gradation CVmax becomes the limit value or less (for example, 40% or less). In the processes shown in FIG. 6, the gradation division number N, step size of the linear gain shift coefficient LGs, and the limit value of the brightness decreasing rate of the maximum gradation may be arbitrarily determined. For example, by increasing the gradation division number N and decreasing the step size of the linear gain shift coefficient LGs, the gradation conversion characteristic and the brightness of the backlight are determined so that the brightness decreasing rate of the maximum gradation CVmax becomes closer to the limit value on various images having the maximum gradation CVmax and the boundary gradation CVth, and the power consumption of the backlight can be reduced more effectively.

Figure 7A:
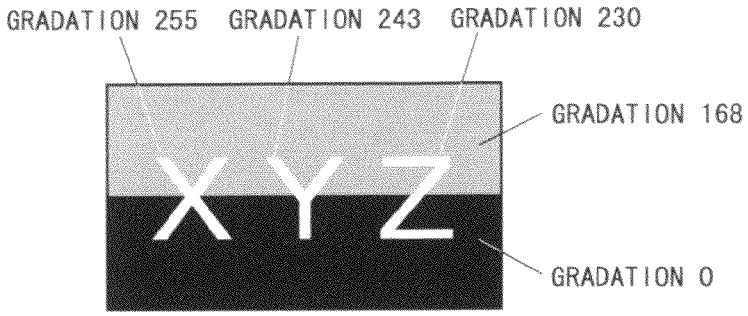
FIG. 7A is a diagram showing an example of an input image of the liquid crystal display device illustrated in FIG. 1.
Figure 7B:
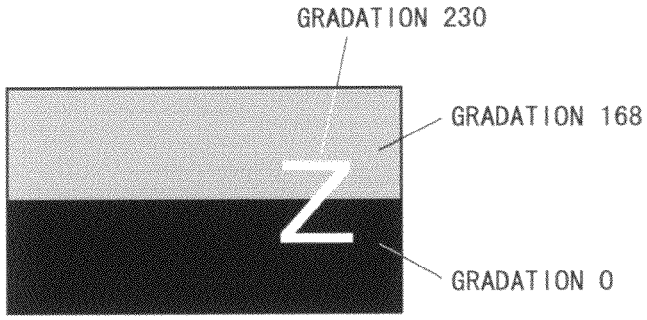
FIG. 7B is a diagram showing another example of the input image of the liquid crystal display device illustrated in FIG. 1.
Figure 7C:
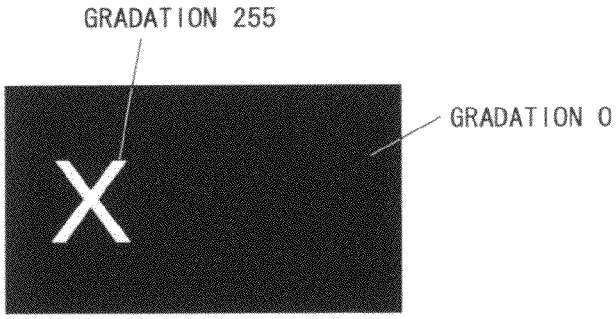
FIG. 7C is a diagram showing another example of the input image of the liquid crystal display device illustrated in FIG. 1.
Figure 7D:
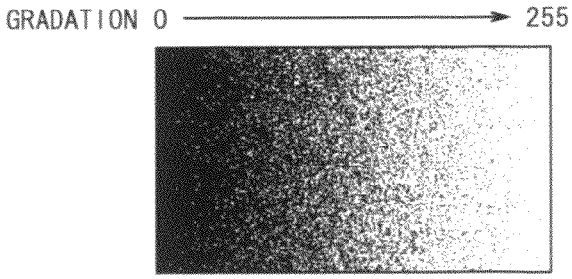
FIG. 7D is a diagram showing another example of the input image of the liquid crystal display device illustrated in FIG. 1.

FIGS. 7A to 7D are diagrams showing an example of the input image of the liquid crystal display device 1. The maximum value CVM of gradation is 255. An image shown in FIG. 7A includes three white characters (gradation are 255, 243, and 230 in order from left) in a background made by a black region (gradation is 0) and a gray region (gradation is 168). An image shown in FIG. 7B includes one white character (gradation is 230) in the same background as that in FIG. 7A. An image shown in FIG. 7C includes one white character (gradation is 255) in the black background (gradation is 0). An image shown in FIG. 7D is a gradation image whose left end is black (gradation is 0) and whose right end is white (gradation is 255). In the images shown in FIGS. 7A to 7C, the occupation ratio of the white character(s) in each of the whole image is less than 10%.

Figure 8:
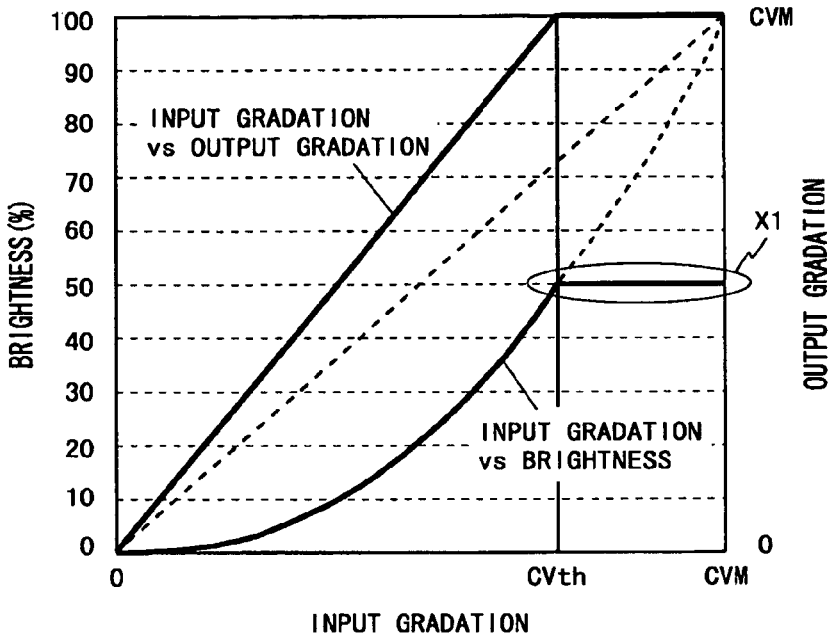
Fig. 8 CONVENTIONAL ART
FIG. 8 is a diagram showing the gradation conversion characteristic and the display brightness characteristic of a conventional first method.

When the images shown in FIGS. 7A to 7D are displayed by the conventional method, the following problems occur. In the case of displaying the image shown in FIG. 7A by using the first conventional method (FIG. 8), all of the three characters are displayed with the same brightness as that of the gray region, and the upper half of the characters and the gray region cannot be discriminated from each other. Also in the case of displaying the image shown in FIG. 7B, the upper half of the characters and the gray region cannot be discriminated from each other. In the case of displaying the image shown in FIG. 7C, the character is displayed with the same brightness as that of the black background and cannot be seen at all. In the case of displaying the image shown in FIG. 7D, a predetermined range from the right end of the image (for example, the range of 10% when CVth is set to the gradation in the position of 90% from the smaller side) is displayed in white with the maximum brightness. In the conventional first method, although the power consumption of the backlight can be reduced largely, so-called gradation collapse that the gradation in a certain range is displayed with the same brightness occurs, so that white characters and the like in the black background cannot be seen.

Figure 9:
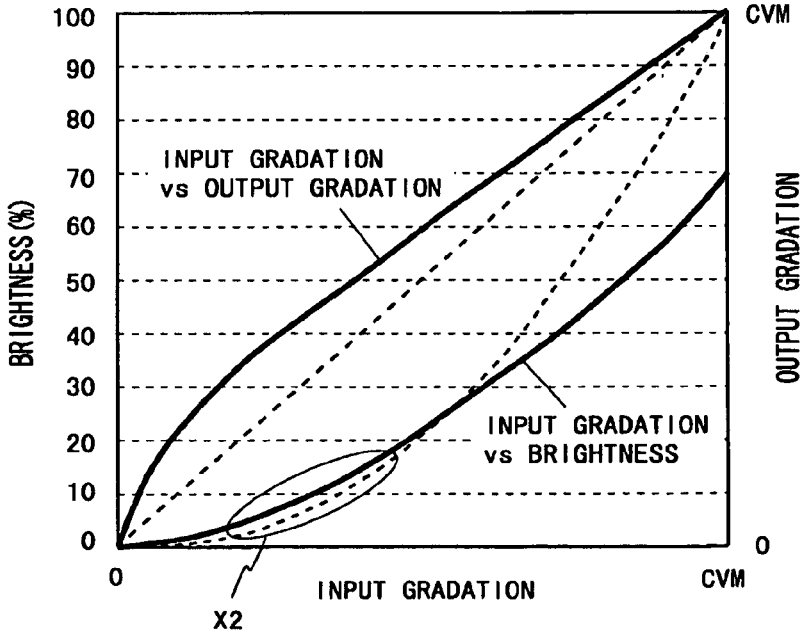
Fig. 9 CONVENTIONAL ART
FIG. 9 is a diagram showing the gradation conversion characteristic and the display brightness characteristic of a conventional second method.

When the images shown in FIGS. 7A to 7D are displayed by using the conventional second method (FIG. 9), a deviation occurs from the original γ curve at almost all the gradations, and the character(s) cannot be displayed with desired brightness. In the case of displaying the images shown in FIGS. 7A, 7C, and 7D by using the method described in the patent document 1, since the maximum value 255 of the gradation is included in the images, the brightness of the backlight cannot be decreased at all. In the case of displaying the images shown in FIGS. 7A to 7C by using the methods of the patent documents 2 and 3, the brightness of the white characters largely decreases.

On the contrary, when the limit value of the brightness decreasing rate of the maximum gradation in the liquid crystal display device 1 according to the embodiment is set to 40% and the images shown in FIGS. 7A to 7D are displayed, the following results are obtained. The brightness of the backlight 30 is reduced by about 21% in the image shown in FIG. 7A, by about 42% in the image shown in FIG. 7B, by about 40% in the image shown in FIG. 7C, and by about 31% in the image shown in FIG. 7D. In the case of displaying the images shown in FIGS. 7A to 7C, the characters are displayed with brightness different from that of the background, so that they can be discriminated from the background. Further, in the case of FIG. 7A, the white characters X, Y, and Z can be displayed with different brightnesses. Although the brightness of the character decreases, the brightness decreasing rate of the maximum gradation is limited, so that the brightness of the characters does not decrease over the limitation. In the case of displaying the image shown in FIG. 7D, although a brightness distribution state changes in a predetermined range from the right end of the image (for example, a range of 20% when the boundary gradation CVth is set to a position of 80% from the smaller side), gradation collapse does not occur also in the range. In the case of displaying the images shown in FIGS. 7A to 7D, deviation from the γ curve of display brightness is small.

As described above, in the liquid crystal display device 1 according to the embodiment, by analyzing an input image and performing brightness control of the backlight 30 based on the analysis result, power consumption of the backlight 30 can be reduced according to the characteristic of the input image. By limiting the brightness decreasing rate of the maximum gradation CVmax when the brightness control of the backlight 30 is performed, the image can be displayed without largely decreasing the brightness of the maximum gradation CVmax or gradations close to the maximum gradation CVmax. By applying a predetermined gain to the gradation smaller than the boundary gradation CVth and applying the gain which monotonously decreases to the gradation larger than the boundary gradation CVth, the gradation collapse can be suppressed and the gradation deviation can be suppressed. Thus, while suppressing picture quality deterioration, power consumption of the backlight can be reduced.

The gradation conversion unit 23 performs the gradation conversion so that the characteristic becomes the spline curve on a gradation larger than the boundary gradation CVth. Consequently, the gradation conversion characteristic in the portion larger than the boundary gradation CVth changes continuously and smoothly. Since the spline curve is tangent, at the boundary gradation CVth, with the gradation conversion characteristic of the portion smaller than the boundary gradation CVth, the gradation conversion characteristic changes continuously and smoothly before and after the boundary gradation CVth. Therefore, the output gradation and the display brightness of the gradation conversion unit 23 are suppressed from becoming discontinuous, and deterioration in the picture quality can be suppressed.

The image analysis unit 22 pre-stores, in the conversion table, the linear gain shift coefficient LGs determined so that the brightness decreasing rate of the maximum gradation CVmax becomes the limit value or less. Consequently, it is unnecessary to perform complicated image analysis computation each time an image is input, and the linear gain shift coefficient LGs in which the brightness decreasing rate of the maximum gradation CVmax becomes the limit value or less can be easily obtained.

The image analysis unit 22 determines the brightness of the backlight 30 so that, for the gradation smaller than the boundary gradation CVth, the display brightness when the brightness control on the backlight 30 and the gradation conversion by the gradation conversion unit 23 are performed coincides with the display brightness when the brightness control and the gradation conversion are not performed. As a result, with respect to the gradation smaller than the boundary gradation CVth, an image can be displayed with the same brightness as that when the brightness control and the gradation conversion are not performed and an image similar to that displayed when the brightness control and the gradation conversion are not performed can be displayed. By determining the brightness of the backlight 30 not based on the maximum value CVM of gradation, but based on the maximum gradation CVmax included in an input image, power consumption of the backlight 30 can be reduced more effectively.

The image analysis unit 22 determines, as the boundary gradation CVth, a gradation in a position at a predetermined ratio from the smaller side of the gradations of pixels included in the input image. Thus, pixels in the predetermined ratio included in the input image can be displayed by performing the gradation conversion of applying a predetermined gain. By suitably controlling the brightness of the backlight 30, the pixels in the predetermined ratio included in the input image can be displayed with the same brightness as that in the case where the brightness control and the gradation conversion are not performed.

The liquid crystal display device 1 of the embodiment can be variously modified. For example, the image analysis unit 22 may determine, as the boundary gradation CVth, a gradation in a position at a predetermined ratio from the larger side of the gradations of pixels included in the input image. Alternatively, the image analysis unit 22 may determine the boundary gradation CVth based on the maximum gradation CVmax. The process (step S5 in FIG. 3) of obtaining the output gradation corresponding to the input gradation based on the maximum gradation CVmax, the boundary gradation CVth, and the linear gain shift coefficient LGs may be performed not by the image analysis unit 22, but by the gradation conversion unit 23. By the method, a display device other than the liquid crystal display device can be constructed. Also by the display devices (including the liquid crystal display device) of the modifications, power consumption of the backlight can be reduced while suppressing deterioration in picture quality.

INDUSTRIAL APPLICABILITY

The display device of the present invention produces an effect that power consumption of the backlight can be reduced while suppressing deterioration in picture quality, so that it can be used as various display devices each having a backlight such as a liquid crystal display device.

The invention claimed is:

1. A display device performing brightness control of a backlight and gradation conversion of an image, comprising:

a display panel including a plurality of pixel circuits;

a drive circuit that drives the display panel;

a backlight that irradiates a back side of the display panel with light;

a gradation conversion unit that performs gradation conversion on an input image, by applying a predetermined gain to a gradation smaller than a boundary gradation and applying, to a gradation larger than the boundary gradation, a gain which decreases as the gradation increases, and that outputs a converted image to the drive circuit; and an image analysis unit that analyzes the input image and determines a gradation conversion characteristic of the gradation conversion unit and brightness of the backlight, wherein the image analysis unit obtains the boundary gradation and a maximum gradation included in the input image based on the input image and, based on the obtained two gradations, determines the gradation conversion characteristic of the gradation conversion unit so that the brightness control of the backlight is performed when the brightness decreasing rate of the maximum gradation becomes a limit value or less, and wherein the gradation conversion is based on a first brightness value at the maximum gradation when the brightness control is performed and the gradation conversion is based on a second brightness value at the maximum gradation when the brightness control is not performed.

2. The display device according to claim 1, wherein the image analysis unit determines a parameter that determines the characteristic of the gradation conversion unit so that the brightness decreasing rate becomes the limit value or less, based on the difference between the maximum gradation and the boundary gradation.

3. The display device according to claim 2, wherein the parameter is a ratio of the difference between the maximum gradation and the boundary gradation.

4. The display device according to claim 3, wherein when the boundary gradation is CVth, the maximum gradation is CVmax, the parameter is LGs, the maximum value of an output gradation of the gradation conversion unit is CVM, {CVth+LGs(Cvmax−CVth)} is set as CVa, and (CVM/CVa)×CVth is set as CVb, the gradation conversion unit performs gradation conversion with a gain of (CVM/CVa) to a gradation smaller than the boundary gradation, and performs gradation conversion to a gradation larger than the boundary gradation so that a characteristic becomes a spline curve using a point (CVth, CVb) as a starting point, a point (CVa, CVM) as a control point, and a point (CVmax, CVM) as an end point.

5. The display device according to claim 2, wherein in the image analysis unit, the parameter which determines that the brightness decreasing rate becomes the limit value or less in association with the difference between the maximum gradation and the boundary gradation is preliminarily stored.

6. The display device according to claim 1, wherein on a gradation larger than the boundary gradation, the gradation conversion unit performs gradation conversion so that the characteristic becomes a spline curve.

7. The display device according to claim 1, wherein the image analysis unit determines brightness of the backlight so that, for a gradation smaller than the boundary gradation, display brightness when the brightness control of the backlight and the gradation conversion by the gradation conversion unit are performed coincides with display brightness when the brightness control and the gradation conversion are not performed.

8. The display device according to claim 1, wherein the image analysis unit determines, as the boundary gradation, a gradation in a position at a predetermined ratio from a smaller or larger side of the gradations of pixels included in the input image.

9. A display method using a display device having a display panel, a drive circuit of the display panel, and a backlight, the method comprising the steps of:

performing gradation conversion on an input image by applying a predetermined gain to a gradation smaller than a boundary gradation and applying, to a gradation larger than the boundary gradation, a gain which decreases as the gradation increases;

driving the display panel based on a converted image by using the drive circuit;

irradiating a back side of the display panel with light by using the backlight; and analyzing the input image and determining a gradation conversion characteristic and brightness of the backlight, wherein in the step of determining the gradation conversion characteristic, the boundary gradation and the maximum gradation included in the input image are obtained based on the input image and, based on the obtained two gradations, the gradation conversion characteristic is determined so that the brightness control of the backlight is performed when the brightness decreasing rate of the maximum gradation becomes a limit value or less, and wherein the gradation conversion is based on a first brightness value at the maximum gradation when the brightness control is performed and the gradation conversion is based on a second brightness value at the maximum gradation when the brightness control is not performed.

* * * * *